US009865975B2

(12) United States Patent
Plamondon et al.

(10) Patent No.: US 9,865,975 B2
(45) Date of Patent: Jan. 9, 2018

(54) HINGED CONNECTOR DOOR ASSEMBLY

(71) Applicant: BELDEN CANADA INC., Saint-Laurent (CA)

(72) Inventors: Jean-Sébastien Plamondon, Laval (CA); Vincent Pilon, Montreal (CA)

(73) Assignee: BELDEN CANADA INC., Saint-Laurent (CA)

( * ) Notice: Subject to any disclaimer, the term of this patent is extended or adjusted under 35 U.S.C. 154(b) by 0 days.

(21) Appl. No.: 15/366,168

(22) Filed: Dec. 1, 2016

(65) Prior Publication Data

US 2017/0155217 A1 Jun. 1, 2017

Related U.S. Application Data

(60) Provisional application No. 62/261,493, filed on Dec. 1, 2015.

(51) Int. Cl.

| | |
|---|---|
| ***H01R 9/03*** | (2006.01) |
| ***H01R 24/62*** | (2011.01) |
| ***E05C 5/00*** | (2006.01) |
| ***E06B 5/00*** | (2006.01) |
| ***H01R 13/58*** | (2006.01) |
| ***H01R 24/64*** | (2011.01) |

(52) U.S. Cl.

CPC ..... *H01R 24/62* (2013.01); *E05C 5/00* (2013.01); *E06B 5/00* (2013.01); *H01R 13/5829* (2013.01); *H01R 24/64* (2013.01)

(58) Field of Classification Search

CPC .. H01R 24/62; H01R 4/2433; H01R 13/5804; E05C 19/10; E06B 5/00

USPC ..... 439/607.41

See application file for complete search history.

(56) References Cited

U.S. PATENT DOCUMENTS

| | | | | |
|---|---|---|---|---|
| 6,238,231 | B1 | 5/2001 | Chapman et al. | |
| 7,578,695 | B2 * | 8/2009 | Boeck | H01R 13/5804 439/460 |
| 7,871,285 | B1 | 1/2011 | Tobey et al. | |
| 7,972,150 | B1 * | 7/2011 | Lin | H01R 4/2433 439/607.03 |
| 2015/0295350 | A1 | 10/2015 | Bragg | |

OTHER PUBLICATIONS

International Search Report of corresponding application No. PCT/CA2016/051409.

* cited by examiner

*Primary Examiner* — Jean F Duverne
(74) *Attorney, Agent, or Firm* — Hugh Mansfield

(57) ABSTRACT

A door assembly for attachment to a connector housing is shown. The door assembly comprises a pair of opposed doors mounted on either side of an opening by a hinge, which when in a closed position define a cable receiving opening there between. Supports are provided on either door which grip the of cable therebetween when the doors are in the closed position. In a particular embodiment a locking mechanism is provided to retain the doors in a closed.

20 Claims, 7 Drawing Sheets

HINGED CONNECTOR DOOR ASSEMBLY

FIELD OF THE INVENTION

The present invention relates to a hinged connector door assembly.

SUMMARY OF THE INVENTION

There is provided a connector door assembly for attachment to a connector housing, the connector housing comprising a rearward end configured for receiving a cable end terminated by a cable termination assembly and defining an opening. The assembly comprises a pair of opposed elongate doors each, a pair of parallel hinges arranged for pivotally connecting an outer edge of a respective one of the doors to the connector housing on opposite sides of the opening. A pair of supports each comprising a cable gripping surface, one of each of the supports mounted to a respective door, and a locking mechanism. When in a closed positon inner edges of the doors define a cable receiving opening there between, the elongate fingers of both of the doors together define a cable jacket receiving region there between.

DETAILED DESCRIPTION OF THE ILLUSTRATIVE EMBODIMENTS

Figure 1A:
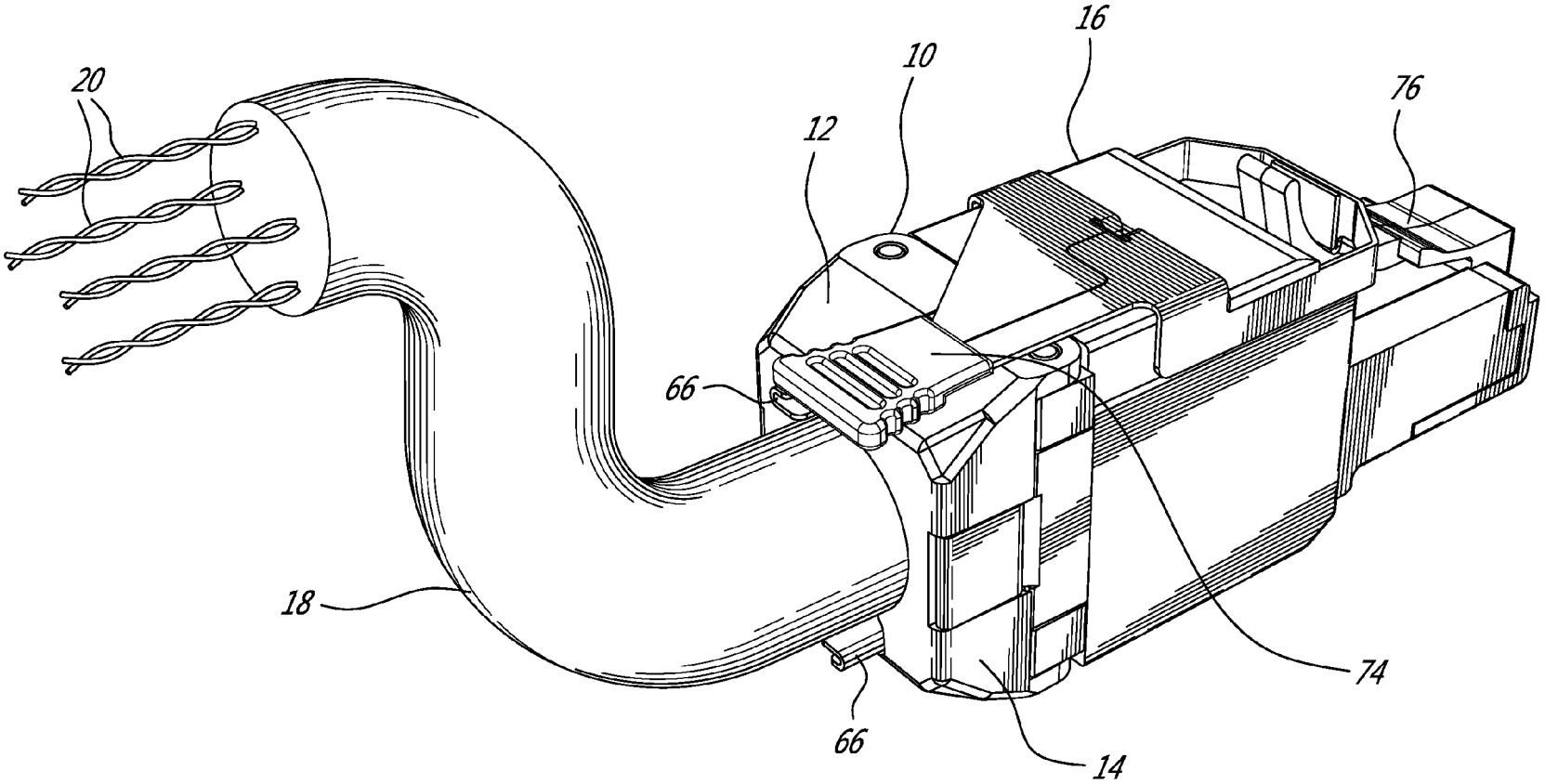
FIG. 1A is a in isometric view of a hinged connector door assembly with cable installed in accordance with an illustrative embodiment of the present invention.

Referring now to FIG. 1A, a hinged connector door assembly, generally referred to using the reference numeral 10, will now be described. The door assembly 10 comprises a pair of illustratively identical elongate opposed door members 12, 14 which work together to close the rear end of a connector housing 16 (such as a plug, as shown, jack/receptacle, or coupler not shown) about a cable 18. The cable 16 is typically comprised of a plurality of twisted pairs of conductors 20 which is terminated by a cable termination assembly and received within the rearward facing opening of the connector housing 16.

Figure 1B:
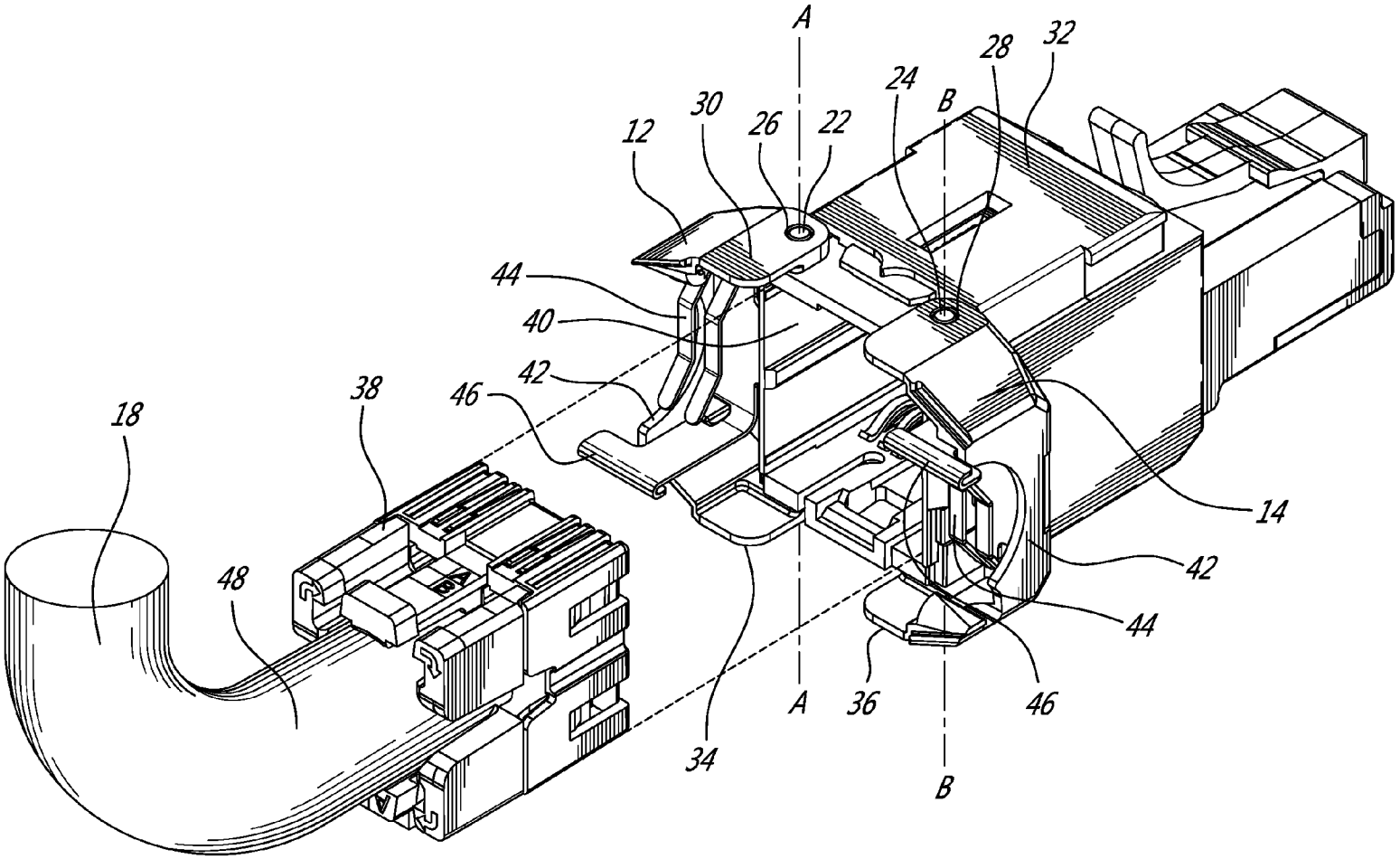
FIG. 1B is a in isometric view of a hinged connector door assembly with cable removed in accordance with an illustrative embodiment of the present invention.

Referring now to FIG. 1B, the doors 12, 14 are each hingedly/pivotally mounted about each of a respective pair of parallel axes A-A, B-B by a hinge. In this regard, the hinge comprises opposed pairs of aligned pins 22, 24 which engage with aligned apertures 26, 28 formed in the opposed upper ends 30, 32 and lower ends 34, 36 of each of the doors 12, 14. The door 12, 14 may be opened to receive illustratively a suitably prepared cable termination assembly 38 into the rearward end 40 of the connector 16. Each door comprises an outer casing 42, manufactured from a rigid material such as diecast metal or plastic, a flexible cable gripping surface 44 and a locking plate 46. On closing of the assembly, the flexible cable gripping surfaces 44 flexibly grip the jacket 48 of the cable 18 there between for example for providing strain relief and increased mechanical strength.

Figure 2B:
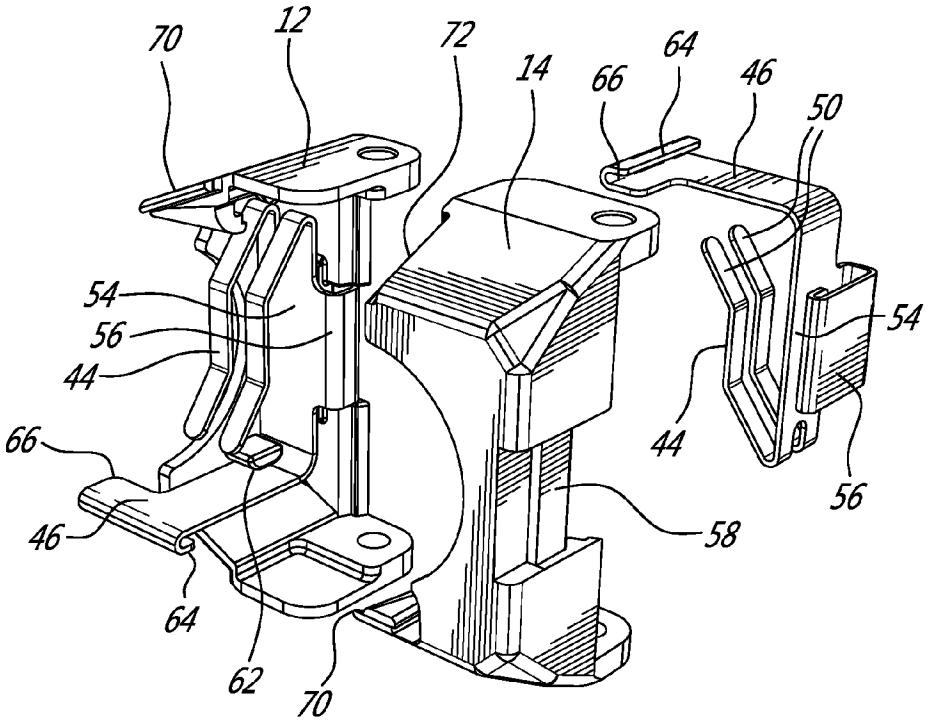
FIG. 2B is an isometric view of a partially exploded pair of doors, one open and one closed, in accordance with an illustrative embodiment of the present invention.
Figure 2A:
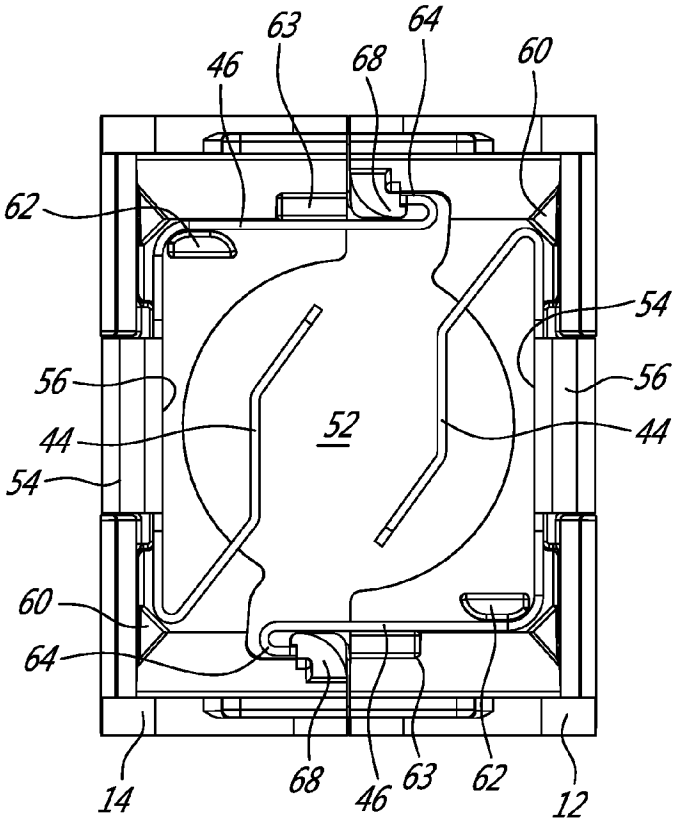
FIG. 2A is a front plan view of a pair of doors in a closed position and in accordance with an illustrative embodiment of the present invention.

Referring now to FIGS. 2A and 2B, each of the gripping surfaces 44 illustratively is comprised of a pair of fingers 50 which are formed such that when assembled and the doors 12, 14 closed, the opposed pairs of fingers define a cable receiving region 52 there between. Illustratively the flexible cable gripping surfaces 44 and locking plate 46 are interconnected by a mounting plate 54 and clip 56, all manufactured from the same piece of material, for example a resilient flexible conductive material such as nickel plated steel or the like.

Still referring to FIGS. 2A and 2B, during assembly the clip 56 is mated with an interlocking surface 58 on the respective door 12, 14. Additional bosses 60, 62, 63 moulded on the inside of each door 12, 14 provide additional support for the gripping surfaces 44 and the locking plate 46 thereby securing each assembly to their respective door 12, 14 in a friction fit. Each locking plate 46 further comprises a hooked end 64 and a release tab 66. When the doors 12, 14 are in a closed position, each hooked end 64 releasably engages a corresponding locking boss 68 moulded or otherwise formed into the inside of each door 12, 14. Simultaneously a lip 70 towards an end of each door 12, 14 is engaged in a groove 72 in the opposing door 12, 14.

Referring back to FIG. 1A in addition to FIG. 2A, the hooked end 64 of each locking plate 46 can be disengaged from its respective boss 68 by moving the opposed release tabs 66 towards one another, thereby releasing the doors 12, 14 and allowing them to eventually be pivoted about their respective axis A-A, B-B. Still referring to FIG. 1A, of note is that in an illustrative embodiment where a handle 74 is provided in order to release a front end 76 of a plug type connector 16 from a receptacle (not shown), in order to allow easy access to the upper release tab 66', the handle 74 is staggered to one side of the connector 16.

Figure 3A:
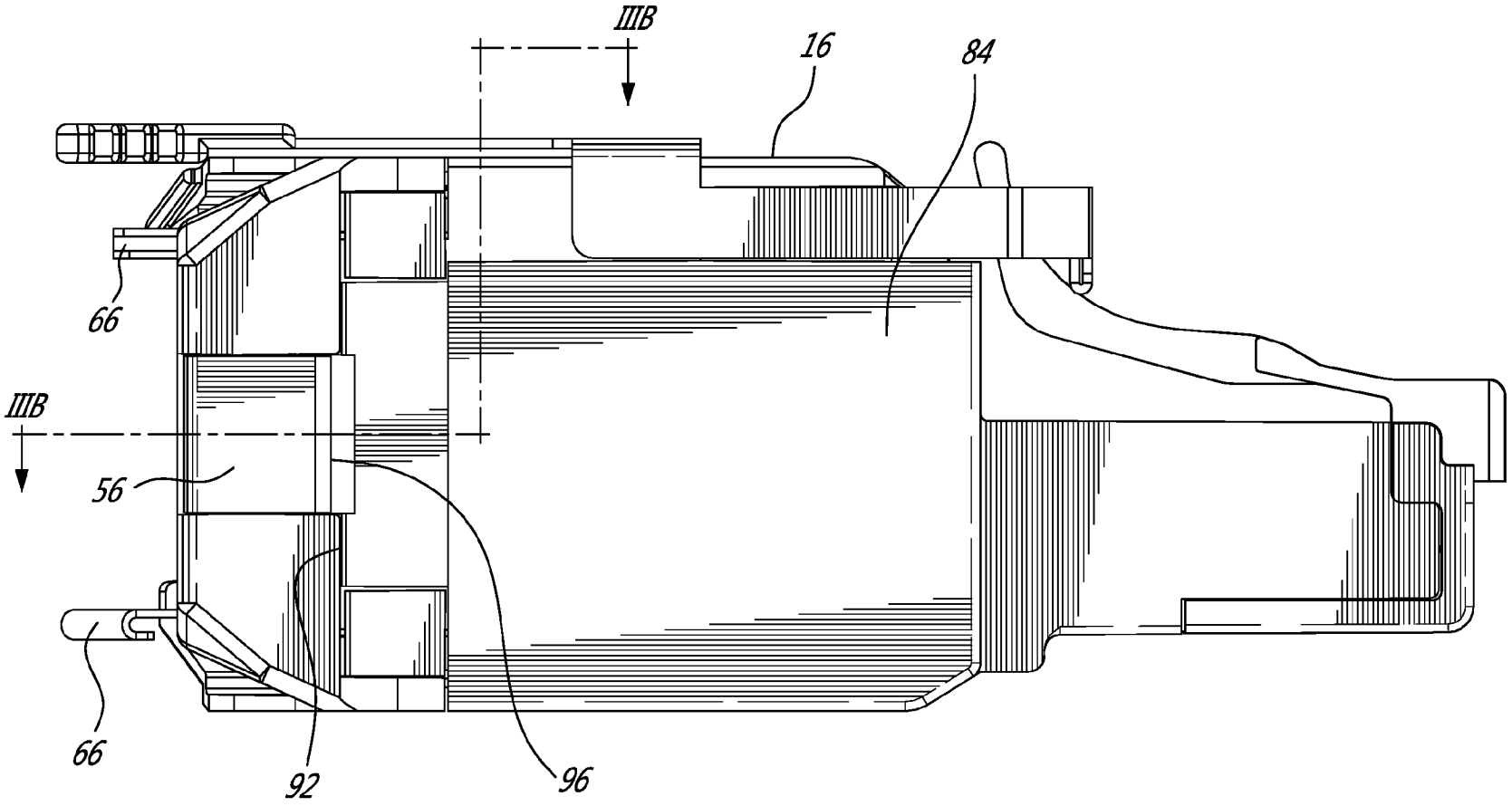
FIG. 3A is a side plan view of a connector in accordance with an illustrative embodiment of the present invention.
Figure 3B:
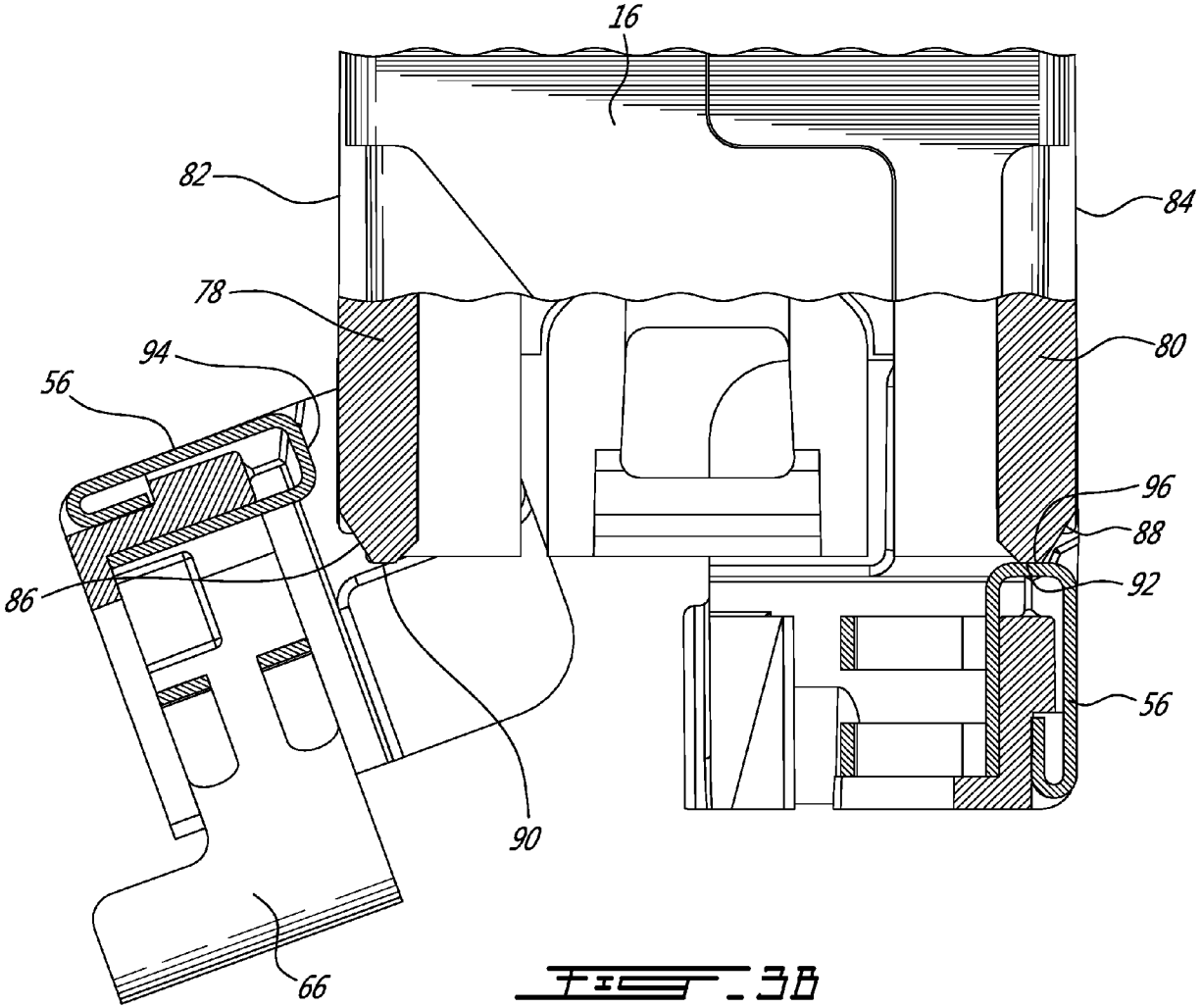
FIG. 3B is a partial sectional view along III-III of the connector in FIG. 3A.

Referring now to FIGS. 3A and 3B, the ends 78, 80 of each side 82, 84 of the connector 16 are profiled with chamfered surfaces 86, 88 and such that they project into the pathway of their respective door 12, 14 as the door is closed. As each door is closed, the tips 90, 92 of each of the chamfered surfaces 86, 88 engage the edges 94, 96 of their adjacent mounting plate 56. This, for example, improves contact between a metal connector housing 16, if used, and the mounting plate 56. In this manner continuous contact between a cable ground (not shown) such as a drain wire, foil or metal jacket or the like and the connector housing 16 can be established. Additionally, the interaction between each tip 90, 92 of the chamfered surfaces 86, 88 and their adjacent mounting plate 56 when closed can be used to bias the doors 12, 14, and such that when the release tabs 66 are actuated, the doors 12, 14 are biased into an open position.

Figure 4B:
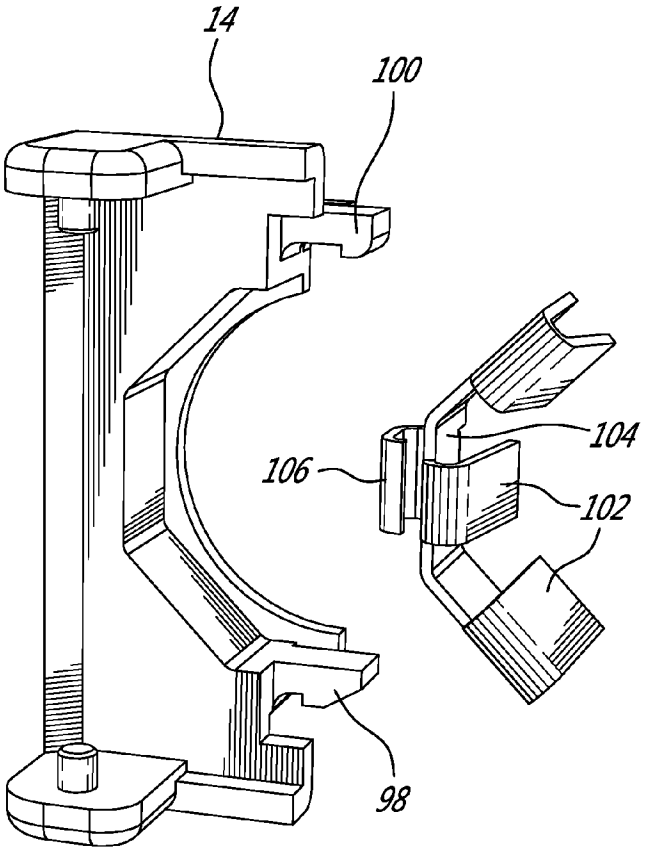
FIG. 4B is a front exploded perspective view of a door in accordance with an alternative illustrative embodiment of the present invention.
Figure 4A:
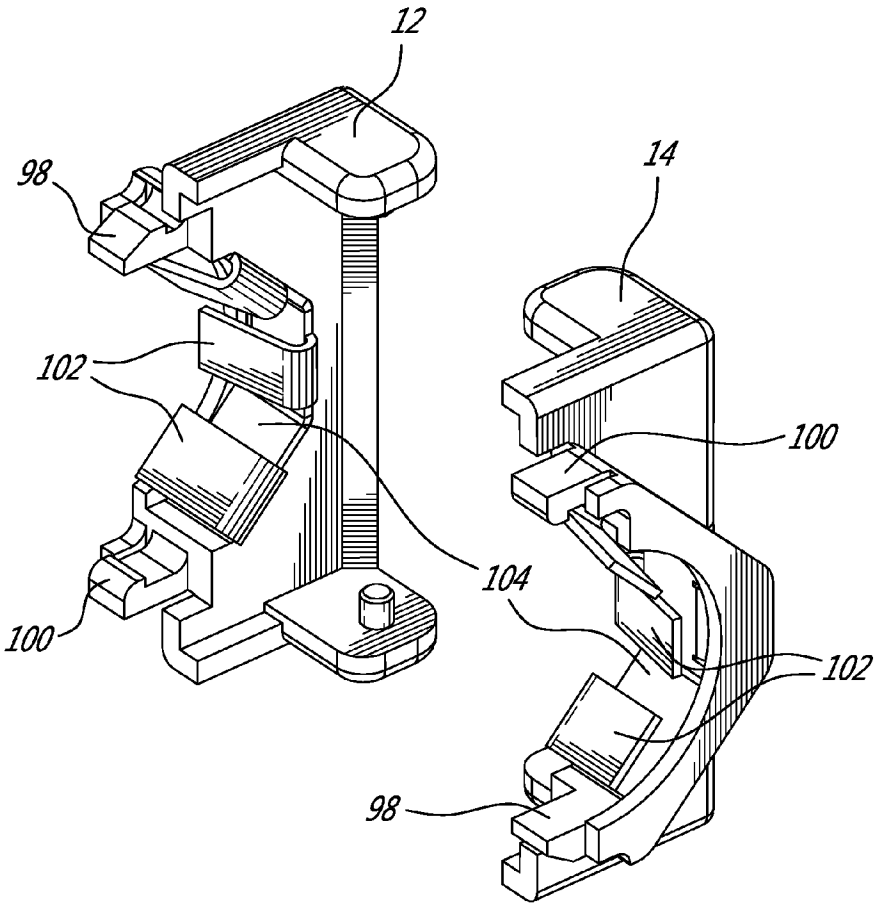
FIG. 4A is an isometric view of a pair of opposed doors in an open position and in accordance with an alternative illustrative embodiment of the present invention.

Referring now to FIGS. 4A and 4B, in a first alternative embodiment, each of the doors 12, 14 comprises an integrated pair of mating locking tabs 98, 100 which mate like tabs on the opposing door thereby securing the doors 12, 14 in a locked position. Additionally, the flexible cable gripping surfaces are provided by a plurality of flexible plates 102, manufactured from metal or the like, which when the doors 12, 14 closed are arranged snugly about the cable, gripping the jacket (both not shown). Each of the plates 102 are mounted to a support 104 which comprises a mounting tab 106 which illustratively is moulded into a respective one of the doors 12, 14.

Figure 5B:
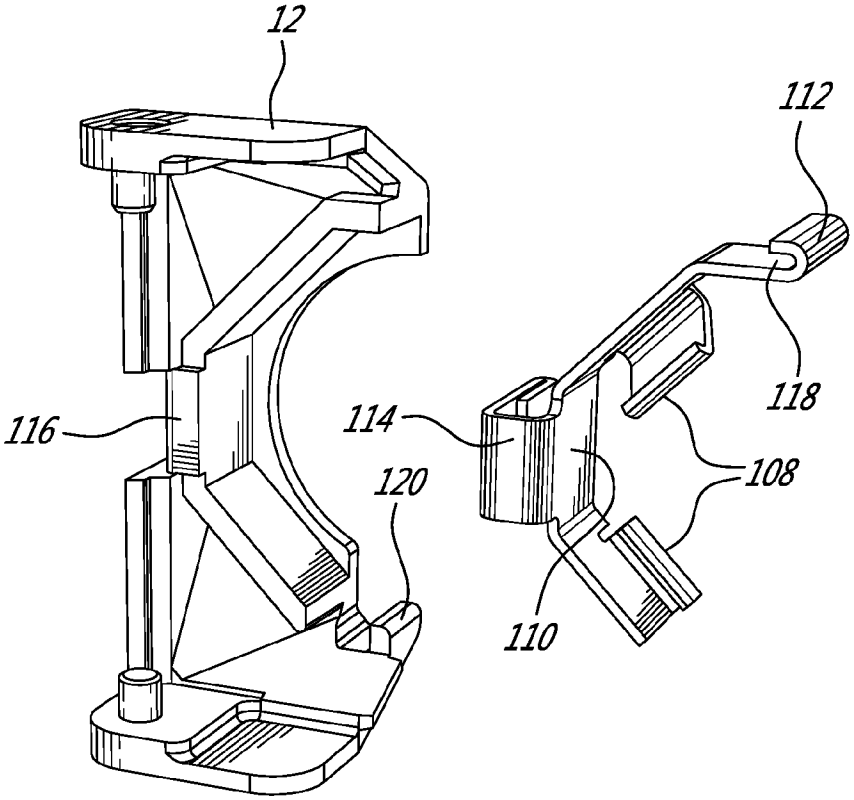
FIG. 5B is a front exploded perspective view of a door in accordance with a second alternative illustrative embodiment of the present invention.
Figure 5A:
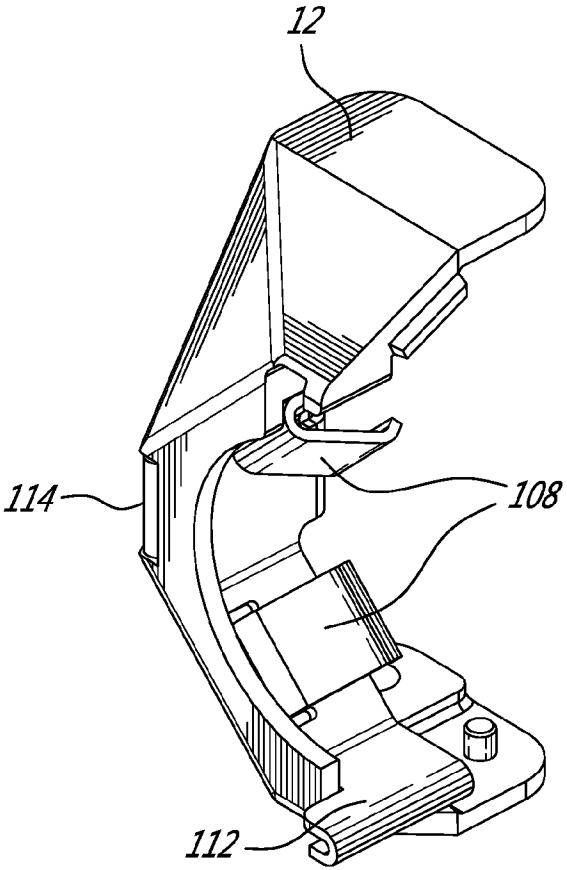
FIG. 5A is an isometric view of a door in accordance with a second alternative illustrative embodiment of the present invention.

Referring now to FIGS. 5A and 5B, a second alternative embodiment of the door 12 is illustrated. Of note is only one door 12 is shown. The second door (14 in FIG. 1A) is the same, merely rotated 180 degrees about its length for mounting on the rearward end of the connector 16. In the second illustrative embodiment the flexible cable gripping surfaces are again provided by a plurality of small plates 108 mounted on a support 110, both manufactured from metal or the like, which when the doors 12, 14 are closed, are arranged snugly about the cable, gripping the jacket (again, both not shown). The support 110 in turn comprises a locking tab 112 and a clip portion 114 for mounting the support 110 about a mounting surface 116 moulded into the door 12. As will now be understood by a person of ordinary skill in the art, in operation the locking tab 112 comprises a hook 118 which engages a locking boss 120 moulded or otherwise formed in the opposing door.

Although the present invention has been described hereinabove by way of specific embodiments thereof, it can be modified, without departing from the spirit and nature of the subject invention as defined in the appended claims.

We claim:

1. A connector door assembly for attachment to a connector housing, the connector housing comprising a rearward end configured for receiving a cable end terminated by a cable termination assembly and defining an opening, the door assembly comprising:

a pair of opposed elongate doors;

a pair of parallel hinges arranged for pivotally connecting an outer edge of a respective one of said doors to the connector housing on opposite sides of the opening;

a pair of supports each comprising a cable gripping surface and a release tab extending outside of said opening, one of each of said supports mounted to a respective door and respective ones of said release tabs are on either side of said opening; and a locking mechanism for securing said doors in a closed position;

wherein when in said closed position, inner edges of said doors define a cable receiving opening there between; and further wherein when said doors are in said closed position by decreasing a distance between said release tabs said hook ends are disengaged from their respective locking boss thereby placing said door assembly in an open position.

2. The assembly of claim 1, wherein said locking mechanism comprises a locking plate comprising a hooked end on each of said supports and a locking boss on each of said doors and further wherein when in said closed position, said hooked end of each of said locking plates engages said locking boss on an opposed one of said doors securing said doors in said closed position.

3. The assembly of claim 1, wherein said locking mechanism comprises at least one pair of mating locking tabs, one of said tabs of each pair on each of said doors and further wherein when in said closed position said locking tabs mate securing said doors in said closed position.

4. The assembly of claim 1, wherein each of said parallel hinges comprises a pair of aligned apertures at opposed ends of a respective one of said elongate doors, said pairs of apertures defining a pivoting axis and engaging respective ones of two pairs of pins each positioned in an opposing relationship on opposite sides of the opening.

5. The assembly of claim 1, wherein each of said doors are identical.

6. The assembly of claim 1, wherein each of said doors are arranged as a reverse mirror image.

7. The assembly of claim 1, wherein said cable gripping surface comprises a plurality of elongate fingers.

8. The assembly of claim 1, wherein said cable gripping surface comprises a plurality of plates.

9. The assembly of claim 1, wherein each of said supports is mounted to said respective one of said doors using a clip.

10. The assembly of claim 1, wherein each of said supports is fabricated from a single piece of flexible conductive material.

11. The assembly of claim 10, wherein said conductive material comprises nickel plated steel.

12. A connector door assembly for attachment to a connector housing, the connector housing fabricated from a conductive material and comprising a rearward end defining an opening and configured for receiving an end of a cable comprising a ground such as a foil or drain wire, the end terminated by a cable termination assembly, the door assembly comprising:

a pair of opposed elongate doors;

a pair of parallel hinges arranged for pivotally connecting an outer edge of a respective one of said doors to the connector housing on opposite sides of the opening;

a pair of supports fabricated from a conductive material, each of said supports comprising a cable gripping surface comprising a plurality of elongate fingers, one of each of said supports mounted to a respective door; and a locking mechanism for securing said doors in a closed position;

wherein when in said closed position, inner edges of said doors define a cable receiving opening there between, said supports are in electrical contact with the connector housing and said elongate fingers are in electrical contact with the ground, thereby interconnecting the ground to the connector housing.

13. The assembly of claim 12, wherein said locking mechanism comprises a locking plate comprising a hooked end on each of said supports and a locking boss on each of said doors and further wherein when in said closed position, said hooked end of each of said locking plates engages said locking boss on an opposed one of said doors securing said doors in said closed position.

14. The assembly of claim 12, wherein said locking mechanism comprises at least one pair of mating locking tabs, one of said tabs of each pair on each of said doors and further wherein when in said closed position said locking tabs mate securing said doors in said closed position.

15. The assembly of claim 12, wherein each of said parallel hinges comprises a pair of aligned apertures at opposed ends of a respective one of said elongate doors, said pairs of apertures defining a pivoting axis and engaging respective ones of two pairs of pins each positioned in an opposing relationship on opposite sides of the opening.

16. The assembly of claim 12, wherein each of said doors are identical.

17. The assembly of claim 12, wherein each of said doors are arranged as a reverse mirror image.

18. The assembly of claim 12, wherein each of said supports is mounted to said respective one of said doors using a clip.

19. The assembly of claim 12, wherein each of said supports is fabricated from a single piece of flexible conductive material.

20. The assembly of claim 12, wherein said conductive material comprises nickel plated steel.

* * * * *